United States Patent [19]

Giffard

[11] Patent Number: 4,614,580

[45] Date of Patent: Sep. 30, 1986

[54] SPIRAL SEPARATOR

[75] Inventor: Philip J. Giffard, Nerang, Australia

[73] Assignee: Mineral Deposits Limited, Australia

[21] Appl. No.: 684,869

[22] Filed: Dec. 21, 1984

[30] Foreign Application Priority Data

Jan. 9, 1984 [AU] Australia ..... PG3112

[51] Int. Cl.[4] ..... B03B 5/52

[52] U.S. Cl. ..... 209/459; 209/493

[58] Field of Search ..... 209/459, 460, 493, 507, 209/144, 211, 143, 210, 427, 434, 490, 697

[56] References Cited

U.S. PATENT DOCUMENTS

| | | | |
|---|---|---|---|
| 1,023,750 | 4/1912 | Morscher | 209/144 |
| 2,219,711 | 9/1940 | Marston | 209/144 |
| 2,431,560 | 11/1947 | Humphreys | 209/459 X |
| 2,952,360 | 9/1960 | Oberg | 209/459 X |
| 2,996,182 | 8/1961 | Fontein | 209/211 X |
| 3,010,579 | 11/1961 | Duesling | 209/211 |
| 3,091,334 | 5/1963 | Morton | 209/144 |
| 4,189,378 | 2/1980 | Wright et al. | 209/459 |
| 4,891,546 | 6/1975 | Humphreys | 209/459 X |

*Primary Examiner*—S. Leon Bashore
*Assistant Examiner*—Thomas M. Lithgow
*Attorney, Agent, or Firm*—Stevens, Davis, Miller & Mosher

[57] ABSTRACT

A splitter assembly for a spiral separator comprises a blade (1) having an upstream working edge (11) and has a rail (3) mounted above the sluice floor (2) to which blade (1) is slideably mounted by means of arm (10) which engages rail (3).

The lower end of working edge (11) is in contact with floor (2) and the position of contact is adjustable along a path extending between a radially outer and radially inner part of floor (2). In preferred embodiments splitter arm (10) is flexible and working edge 11 moves in a path which is curvilinear with respect to a vertical and a horizontal plane.

12 Claims, 4 Drawing Figures

SPIRAL SEPARATOR

FIELD OF THE INVENTION

This invention relates to an improved splitter for use with a spiral separator.

A spiral separator is an apparatus for the separation of particles of higher density from particles of lower density when a mixture of such particles suspended in a slurry is fed through the separator. The separator is in the form of a generally helical sluice supported with the helix axis upright.

It is usual to feed a stream of slurry, for example water containing suspended solids, into the upper part of such a sluice and to permit the liquid and solids to flow down the sluice under gravity. If the shape of the sluice is correctly chosen, the higher density particles tend to travel more slowly than the lower density particles and under the influence of gravity tend to concentrate towards the inner edge of the sluice, whereat a fraction of concentrated heavy particles may be removed by means of a splitter and take-off.

BACKGROUND ART

Australian application No. 46168/72 which corresponds to U.S. Pat. No. 4,189,378 describes a splitter having a blade extending vertically and mounted for rotation about an upright pivotal axis in relation to a conical or cylindrical take off in the floor of the sluice with the vertical blade diverting adjustable proportions of concentrate into the take off. Such devices have the disadvantage that the maximum adjustment range is limited by the necessarily planar face to the top of the take off at which the splitter rotates and the incorporation of such a planar surface into the floor of the helical sluice causes severe distortion to the normal shape of the latter with consequent flow distortion if the take off is of excessive diameter. In this case also, the protruding splitter blade causes severe flow disturbance when rotated to a position such that little or no concentrate is taken.

It is also known, to remove the amount of concentrate taken by providing a radial slot of adjustable length in the floor of sluice. Such a splitter is described in Australian Patent Specification No. 37175/78 which corresponds to U.S. Pat. No. 3,891,546. The disadvantages of such apparatus are that the adjustment mechanism is exposed to the solids in suspension which tend to jam the mechanism and, also, that the existence of the radial slot tends to weaken the structure of the sluice with increased probability of distortion and difficulty of manufacture.

The object of the present invention is an improved device for the splitting off and removal of a fraction of particles and which avoids or ameliorates the above mentioned disadvantages of previous splitters.

DISCLOSURE OF THE INVENTION

According to one aspect the invention consists in: a splitter assembly for dividing a flow of particles or slurry descending a sluice of a spiral separator, said assembly comprising a splitter blade having an upstream working edge, and means above the sluice floor for mounting the blade with a lower end of the working edge in contact with the sluice floor, said mounting means permitting the position of contact of said working edge to be adjusted by translational movement along a path extending between a radially outer and a radially inner part of the sluice floor.

For preference the blade working edge is movable in a curvilinear path from a first position closely adjacent to the radially inner wall of the sluice to a second position which is at a greater radial distance from the inner wall than the first position and is upstream of the first position.

In a highly preferred embodiment the splitter blade has an integral flexible arm which is supported over the trough floor by a rail or other guide means. The arm is flexible in both a vertical and a horizontal plane and the guide means permit the working edge to maintain contact with a curved sluice bottom while traversing a curvilinear path from one position to another. The path may be curvilinear with respect to a vertical plane, a horizontal plane or both.

BRIEF DESCRIPTION OF DRAWINGS

The present invention will now be described by way of example only with reference to the accompanying drawings in which.

DESCRIPTION OF EMBODIMENTS

Figure 1:
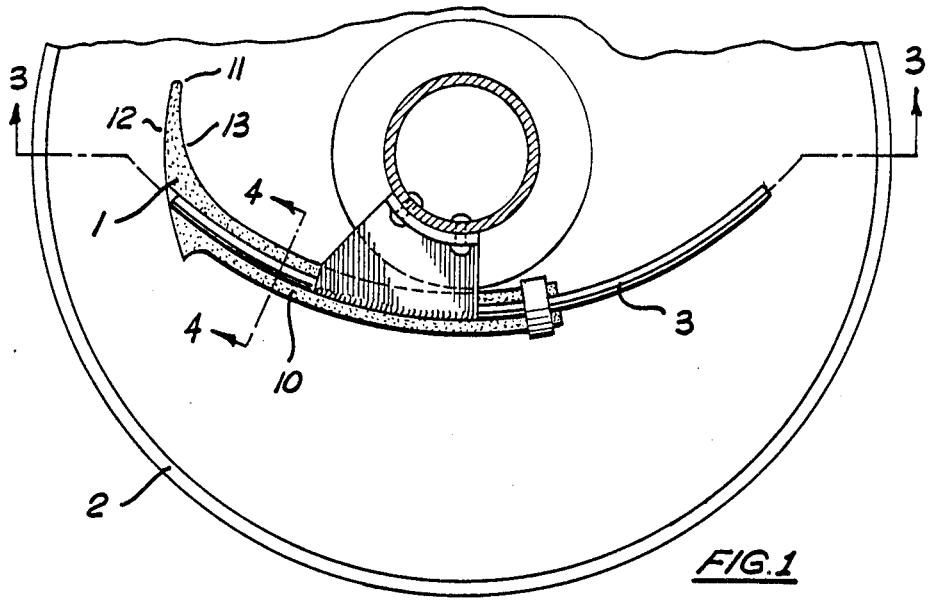
FIG. 1 shows a plan view of a splitter arrangement according to the invention.

With reference to the drawings there is shown a splitter part having a blade portion 1 and an arm portion 10 extending longitudinally from, and integral with, the blade portion.

The upstream end of blade portion 1 has a working edge 11 which in use is presented towards the flow. In plan, edge 11 is defined at the intersection of two curved blade faces 12, 13. Edge 11 extends upwardly from a point of contact with floor 2 of the sluice.

In the present example blade portion 1 and associated arm 10 are moulded integrally from a flexible material for example a rubber or elastomeric polyurethane material. The flexible splitter blade portion 1, is held in contact with the floor surface of the sluice 2 by a rail 3 mounted above and spaced apart from the working surface of the sluice and bearing on the top of flexible splitter arm 10. The angle of the splitter blade 1 to the flow is such that the flow to the inside of the working edge 11 of the splitter is directed to the radially inner edge of the sluice where if desired it may be removed at a take-off 20. Curved surfaces 12, 13 assist in directing the flow of the stream split at edge 11 in a desired manner.

Figure 2:
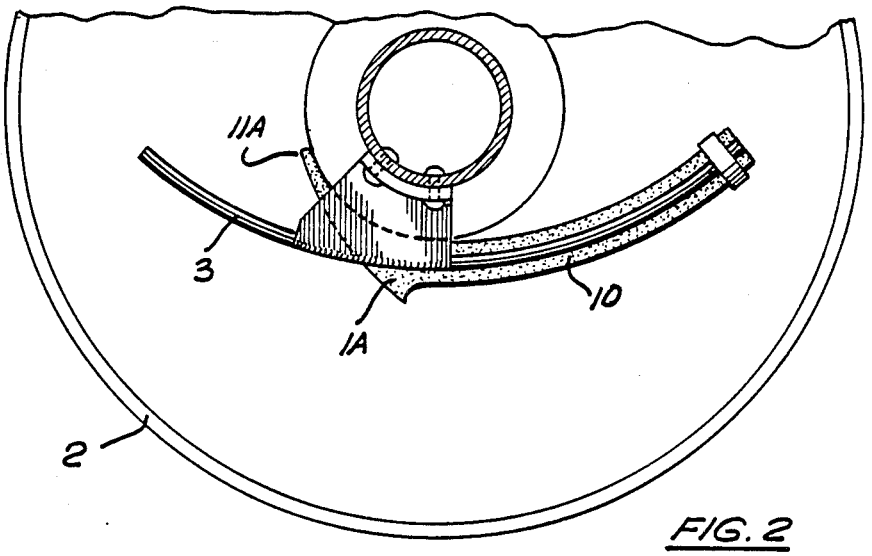
FIG. 2 shows the splitter of FIG. 1 in a retracted position.

The position of the blade is movable with respect to the trough floor by sliding arm 10 along the guide rail. FIG. 2 show arm 10 moved to a second position in which the blade is shown at 1A and its working edge is at 11A.

Figure 3:
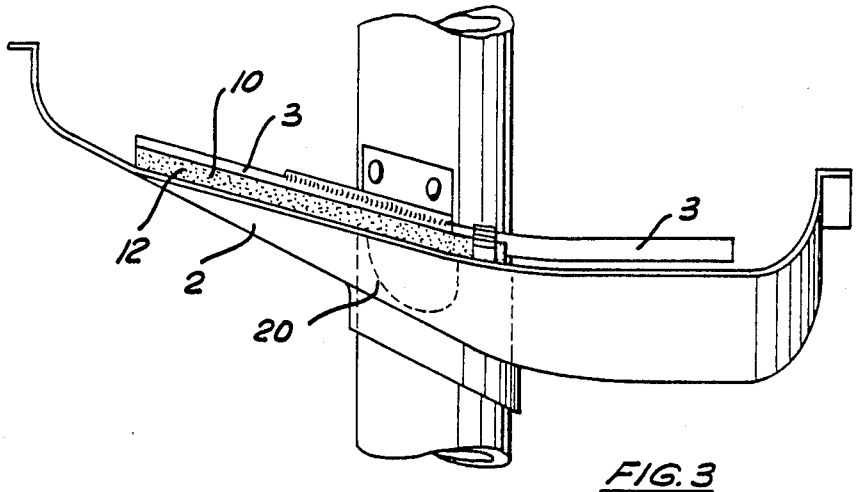
FIG. 3 shows the splitter arrangement of FIG. 1 in section taken on line 3—3 of FIG. 1.
Figure 4:
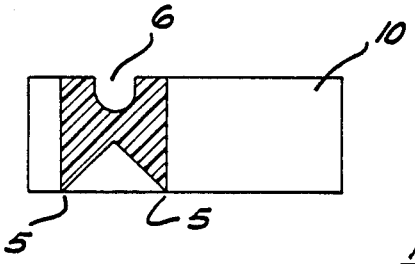
FIG. 4 shows a cross-section of the splitter a part of FIG. 1 taken on line 4—4.

The embodiment of the invention shown in FIG. 3 employs an arm 10 having a cross-section as shown in FIG. 4 having two ribs 5 in contact with the floor of the sluice and a slot 6 in the top surface of arm 10 adapted to slideably engage a rail 3 (not shown in FIG. 4). Rail 3 and ribs 5 serve to maintain the splitter in position against onflow. Arm 10 is able to twist about rail 3 so that ribs 5 maintain engagement with the trough floor while the arm is slid relative to rail 3.

Embodiments in which the undersurface of arm 10 are flat or ribbed as shown in FIG. 4, have a disadvantage in that rail 3 must have a correct angular relationship with the sluice surface. In other embodiments (not illustrated) there is provided an arm 10 having a rounded lower edge and a rail 3 of sufficient width to stabilise arm 10 against rotation about its longitudinal axis. Rail 3 may optionally be provided with flanges operating on the upper or side edges of the splitter in place of a centre slot.

In yet another embodiment there is provided a splitter having an upper surface of semi-circular cross-section and operating within a rail of matching form.

Preferred embodiments of the invention provide a number of advantages over previously used splitters.

The splitter may be used with a separator sluice of which the working surface profile (when viewed in cross-section in a vertical plane through the spiral axis) is curvilinear.

Since the guide rail is not required to be straight in plan or elevation, a splitter system is readily constructed to traverse as much of the radius of the helix as is desired without introducing unwanted distortions to the sluice profile. The splitter may be moved to a position out of the slurry flow or removed entirely so that minimal disturbance results when no concentrate is being taken.

One design of flexible splitter and associated splitter arm may be made applicable to a variety of different sluice profiles, only the rail profile requiring to be modified to suit the sluice profile.

The blade portion and arm may readily be cast as an integral unit from elastomers and the rail complete with support brackets may be cast from a reinforced plastic or preferably is manufactured from stainless steel.

The assembly does not require high accuracy of construction for effective operation. The splitter is not prone to jamming due to accumulation of solids between the splitter and the trough floor. Sluices employing splitters according to the invention may be manufactured without requirement for slots or mounting apparatus in the sluice floor.

If preferred other construction materials may be employed for manufacture of arm 10. Other embodiments in which a splitter blade is carried by a bogey or other means on a rail or track in a predetermined path can readily be envisaged and are within the scope of the disclosure. Splitters according to the invention need not be used to direct a divided fraction into an opening in the column but may be used to direct a fraction into an adjacent channel or into other separators or in some circumstances merely to deflect an undivided stream.

To an extent which will be apparent to those skilled in the art from the teaching hereof, the features of the embodiments may be modified or combined without departing from the inventive concept disclosed herein and such modifications and combinations are within the scope hereof.

I claim:

1. A splitter assembly for dividing a flow of particles or slurry descending a sluice of a spiral separator, said assembly comprising a splitter blade having an upstream working edge, and means supported by said spiral separator above the sluice floor for mounting the blade with a lower end of the working edge in contact with and movable across the width of the sluice floor of the separator in which the assembly is located, said mounting means for adjustably changing the position of contact of said working edge by translational movement along a path extending between a radially outer and a radially inner part of the sluice floor to vary the width of the flow being divided by the splitter assembly.

2. A splitter assembly according to claim 1 wherein the means for mounting the blade is positioned such that the working edge of the blade is moveable in a curvilinear path from a first position to a second position which is at a greater radial distance from the spiral axis than the first position and is upstream of the first position.

3. A splitter assembly according to claim 1 wherein the mounting means includes a guide rail and said blade further comprises an arm which is slideably mounted to the guide rail.

4. A splitter assembly according to claim 3 wherein the guide rail is curvilinear and the arm is sufficiently flexible to follow the curve of the guide rail.

5. A splitter assembly according to claim 1 wherein the blade includes lower ribs adapted to contact the sluice floor whereby to stabilise the position of the working edge.

6. A splitter assembly according to claim 1 wherein the blade is integral with the associated arm and made from a flexible plastic material.

7. A splitter assembly according to claim 1 wherein the working edge is a knife edge at the intersection of two curved blade surfaces.

8. A spiral separator according to claim 1 and having a sluice working surface of non-linear profile with respect to a vertical plane.

9. A spiral separator according to claim 8 wherein the blade is movable to a position at or adjacent the radially innermost edge of the sluice working surface.

10.A spiral separator according to claim 1 further comprising take off means downstream of the working edge of the splitter end adapted to receive a part of a slurry stream divided by the working edge.

11. A separator according to claim 1 wherein said mounting means comprises a cantilevered arm supported from the spiral separator.

12. The assembly of claim 1 in which the spiral separator has a central column and the means for mounting the blade is supported from the central column.

* * * * *